US008287785B2

(12) United States Patent
Schmidtbauer et al.

(10) Patent No.: US 8,287,785 B2
(45) Date of Patent: Oct. 16, 2012

(54) PROCESS FOR THE MANUFACTURE OF SOLID REGENERATED VISCOSE FIBERS

(75) Inventors: Josef Schmidtbauer, Vöcklabruck (AT); Heinrich Schmidt, Vöcklabruck (AT); Susanna Schiemer, Linz (AT)

(73) Assignee: Lenzing Aktiengesellschaft, Lenzing (AT)

( * ) Notice: Subject to any disclaimer, the term of this patent is extended or adjusted under 35 U.S.C. 154(b) by 0 days.

(21) Appl. No.: 13/017,280

(22) Filed: Jan. 31, 2011

(65) Prior Publication Data

US 2011/0212833 A1 Sep. 1, 2011

Related U.S. Application Data

(63) Continuation of application No. 11/029,885, filed on Jan. 5, 2005, now abandoned, which is a continuation of application No. PCT/EP03/06926, filed on Jun. 30, 2003.

(60) Provisional application No. 60/394,621, filed on Jul. 9, 2002.

(30) Foreign Application Priority Data

Jul. 9, 2002 (AT) ..... 1035/2002

(51) Int. Cl.

| | |
|---|---|
| ***D01D 5/06*** | (2006.01) |
| ***D01D 5/12*** | (2006.01) |
| ***D01D 5/253*** | (2006.01) |
| ***D01D 5/26*** | (2006.01) |
| ***D01F 2/08*** | (2006.01) |
| ***D02J 1/22*** | (2006.01) |

(52) U.S. Cl. ..... 264/143; 264/177.13; 264/198; 264/210.4; 264/210.8; 264/211.14

(58) Field of Classification Search ..... 264/130, 264/143, 177.13, 188, 198, 210.4, 210.8, 264/211.14

See application file for complete search history.

(56) References Cited

U.S. PATENT DOCUMENTS

| | | | | |
|---|---|---|---|---|
| 2,491,938 | A | * | 12/1949 | Schlosser et al. ..... 264/198 X |
| 4,104,214 | A | | 8/1978 | Meierhoefer |
| 4,129,679 | A | | 12/1978 | Woodings |
| 4,136,697 | A | | 1/1979 | Smith |
| 4,165,743 | A | | 8/1979 | Denning |
| 4,362,159 | A | | 12/1982 | Sakurai |
| 4,388,260 | A | * | 6/1983 | Bockno ..... 264/198 X |
| 4,575,376 | A | * | 3/1986 | Shah et al. ..... 264/198 X |
| 5,364,383 | A | | 11/1994 | Hayes |
| 5,443,776 | A | | 8/1995 | Bartholomew |
| 5,458,835 | A | | 10/1995 | Wilkes |
| 5,634,914 | A | | 6/1997 | Wilkes |
| 5,686,034 | A | | 11/1997 | Frankham |
| 5,980,924 | A | | 11/1999 | Yamazaki |

FOREIGN PATENT DOCUMENTS

| | | |
|---|---|---|
| CA | 1116825 | 1/1982 |
| EP | 0301874 | 6/1992 |
| JP | S57-71412 | 5/1982 |
| JP | 2001-146680 | 5/2001 |
| NL | 102587 | 9/1962 |
| WO | WO2004/005595 | 1/2004 |
| WO | WO2004/085720 | 10/2004 |

OTHER PUBLICATIONS

U.S. Appl. No. 11/029,885, filed Jan. 5, 2005.

U.S. Appl. No. 11/029,885, Feb. 17, 2009.

U.S. Appl. No. 11/029,885, Jul. 24, 2009.

U.S. Appl. No. 11/029,885, Mar. 11, 2010.

U.S. Appl. No. 11/029,885, Oct. 29, 2010.

DIN 53814, "Testing of textiles; determination of water retention power of fibres and yarn cuttings," Materials Testing Standards Committee, SDo Approval date Oct. 1974, NSSN database file updated May 24, 2007.

European Disposables and Nonwovens Association (EDANA) Test method ERT 350.0-02, "Absorbent hygiene products: Syngina method (tampons)," revised 2005.

European Pharmacopoeia 4, "Viscose Wadding, Absorbent," Jan. 2002:0034, 2120-2121.

Gotze, K., "Chemiefasern nach dem Viskoseverfahren," 3rd edition, Springer-Verlag, 1967.

Rayon, 2007, "How products are made—vol. 1," http://www.madehow.com/Volume-1/Rayon.html.

Treiber, E., "Verzug, Verstreckung und Querschnittsmodifizierung," Chemiefasern 5:1967, 344-348.

Zellcheming-Merkblatt III/5/E, "Verein Der Zellstoff-Und Papier-Chemiker Und-Ingenieure," ausgegeben am 1.6. 1954.

* cited by examiner

*Primary Examiner* — Leo B Tentoni

(74) *Attorney, Agent, or Firm* — Baker Botts L.L.P.

(57) ABSTRACT

The present invention concerns a process for the manufacture of solid regenerated viscose fibers, comprising the steps of: —spinning a viscose spinning dope through a spinneret comprising spinning holes into a regenerating bath thereby forming filaments, —said viscose spinning dope having an alkali ratio immediately before spinning of from 0.7 to 1.0, preferably from 0.8 to 0.9, —at least part of said spinning holes having a circular orifice, —said regenerating bath containing—from 70 to 120 g/l, preferably 90 to 110 g/l sulfuric acid, —from 240 to 380 g/l, preferably 330 to 370 g/l sodium sulphate, —from 20 to 50 g/l, preferably 25 to 35 g/l zinc sulphate and said regenerating bath having a temperature of from 45 to 55° C., preferably 48 to 50° C., —stretching said filaments after leaving said regenerating bath in a secondary bath and/or in air at a stretching ratio of from 70% to 90%, preferably 80% to 90% of the maximum stretching ratio as hereinbefore defined and —treating said filaments with a fatty acid ester.

14 Claims, 5 Drawing Sheets

FIG. 7
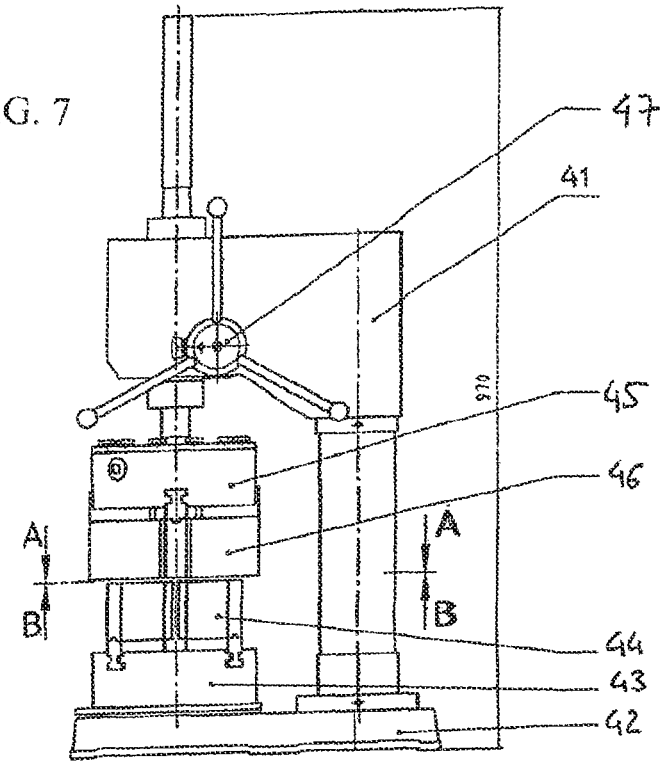
FIG. 8
section A–A
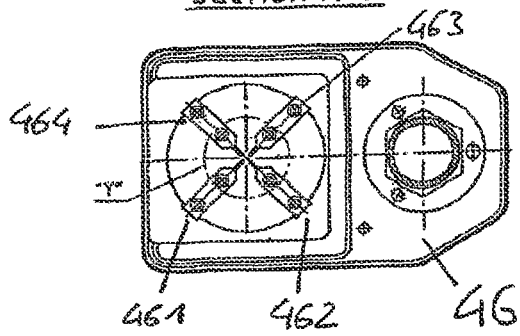
section B–B
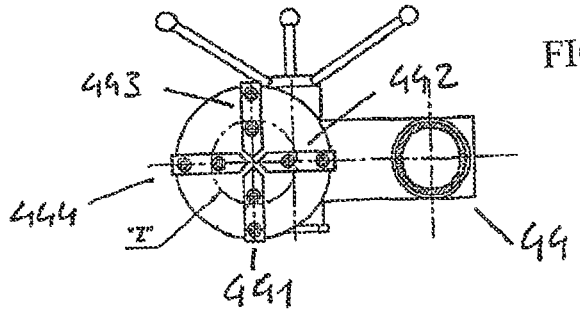
FIG. 9 detail Y (1:1)

detail Z (1:1)

PROCESS FOR THE MANUFACTURE OF SOLID REGENERATED VISCOSE FIBERS

CROSS REFERENCE TO RELATED APPLICATION(S)

The present application is a continuation of U.S. patent application Ser. No. 11/029,885, filed Jan. 5, 2005, now abandoned, which is a continuation of International Patent Application No. PCT/EP03/006926, filed Jun. 30, 2003, published in English on Jan. 15, 2004 as International Patent Publication No. WO04/005595, which claims priority of Austrian Application No. A 1035/2002, filed Jul. 9, 2002 and U.S. Provisional Patent Application No. 60/394,621 filed Jul. 9, 2002, all of which are incorporated herein in their entireties.

The present invention relates to a process for the manufacture of solid regenerated viscose fibres, to fibres obtainable by such process and to absorbent products including such fibres, especially tampons.

For the purposes of the present invention, the term "viscose fibres" is meant to encompass all types of regenerated viscose fibres, such as standard viscose fibre, Modal fibre and polynosic fibre.

State-of-the-art fibre materials commonly used for the manufacturing of tampons are regular viscose fibres, so-called trilobal viscose fibres and cotton. The specific absorbency of these fibres according to the Lenzing Syngina test as described below is approx. 4.5 g/g for cotton, 5.5 g/g for regular viscose and 6.5 g/g for trilobal viscose fibres.

It is the aim of tampon manufacturers to obtain a certain level of absorbency with a minimum amount of fibre material and costs.

Whereas cotton is going to be phased out as a fibre material for tampons due to its insufficient absorbency, trilobal fibres are much more expensive to produce and much more difficult to process into tampons compared to regular viscose.

In order to enhance the absorbency of cellulosic fibres, many different approaches have been reported:

1. a chemical modification by grafting of monomers onto the cellulosic fibre,
2. a chemical modification by incorporation of absorbent polymers like carboxymethyl-cellulose, chitosan, cellulose carbamate, alginate or guaran into the cellulosic fibre matrix
3. a physical modification of the fibres such as hollow fibres or collapsed hollow fibres as known for example from U.S. Pat. No. 4,129,679 or
4. multilimbed fibres (so-called "trilobal" fibres) obtained by using spinnerets with multilimbed extrusion holes having at least 3 limbs with an aspect ratio of 2:1 to 10:1 as known for example from EP-A1 0 301 874.

The disadvantage of a chemical modification of the cellulosic fibre is, that a costly and time-consuming toxicological and physiological testing procedure is needed for very sensitive medical applications like tampons and that the occurrence of the Toxic Shock Syndrome (TSS) prevents most tampon manufacturers from using chemically modified fibre materials, although the chemicals may regarded as safe.

The disadvantage of hollow and collapsed hollow fibres is, that they are difficult to produce because of their high water retention value, which makes the fibres swell strongly during washing and stick together by formation of hydrogen bonds during drying, making them brittle in the dry state, soapy in the wet state and difficult to open and process into a carded web.

The disadvantage of multilimbed fibres spun from spinnerets with multilimbed extrusion holes is, that such spinnerets are very expensive to manufacture, that the spinnerets are sensitive to clogging and have to be changed frequently, thus reducing the productivity of a spinning line and that the fragile limbs of the fibre can break during the carding process under formation of fibre dust.

SUMMARY OF THE INVENTION

The present invention relates to a process for the manufacture of solid regenerated viscose fibres, comprising the steps of spinning a viscose spinning dope through a spinneret comprising spinning holes into a regenerating bath thereby forming filaments, said viscose spinning dope having an alkali ratio immediately before spinning of from 0.7 to 1.0, preferably from 0.8 to 0.9, at least part of said spinning holes having a circular orifice, said regenerating bath containing from 70 to 120 g/l, preferably 90 to 110 g/l sulfuric acid, from 240 to 380 g/l, preferably 330 to 370 g/l sodium sulphate, from 20 to 50 g/l, preferably 25 to 35 g/l zinc sulphate and said regenerating bath having a temperature of from 45 to 55° C., preferably 48 to 50° C., stretching said filaments after leaving said regenerating bath in a secondary bath and/or in air at a stretching ratio of from 70% to 90%, preferably 80% to 90% of the maximum stretching ratio as hereinbefore defined and treating said filaments with a fatty acid ester. The present invention also relates to solid regenerated viscose fibers and staple fibers obtained using the claimed method, and products produced using the fibers.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein:

FIG. 7 shows the mechanical press used in the preparation of the specimen for the Syngina test.

FIG. 8 shows a sectional view of the mechanical press shown in FIG. 7 according to lines A-A.

FIG. 9 shows a sectional view of the mechanical press shown in FIG. 7 according to lines B-B.

DETAILED DESCRIPTION OF THE INVENTION

Figure 1:
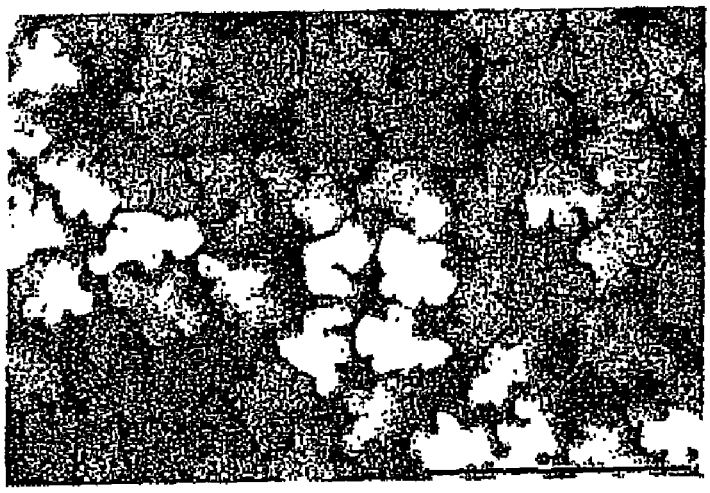
FIG. 1 shows a cross section of fibers obtained through the process described in Example 1.

It is an object of the present invention to provide a process for the manufacture of regenerated cellulosic fibres, especially viscose fibres, which are solid (i.e. not hollow or collapsed-hollow), which are not multilimbed like the fibres known from EP-A1 0 301 874 and which have improved absorbency. The process should involve only moderate production costs.

It is a further object of the present invention to provide regenerated cellulosic fibres, which are solid and are not multilimbed, but in spite of this fact have improved absorbency.

Finally, it is an object of the present invention to provide absorbent products, especially tampons, including such novel fibres.

The process according to the invention for the manufacture of solid regenerated viscose fibres, comprises the steps of:

- spinning a viscose spinning dope through a spinneret comprising spinning holes into a regenerating bath thereby forming filaments,
- said viscose spinning dope having an alkali ratio immediately before spinning of from 0.7 to 1.0, preferably from 0.8 to 0.9,
- at least part of said spinning holes having a circular orifice,
- said regenerating bath containing
  - from 70 to 120 g/l, preferably 90 to 110 g/l sulfuric acid,
  - from 240 to 380 g/l, preferably 330 to 370 g/l sodium sulphate,
  - from 20 to 50 g/l, preferably 25 to 35 g/l zinc sulphate and
- said regenerating bath having a temperature of from 45 to 55° C., preferably 48 to 50° C.,
- stretching said filaments after leaving said regenerating bath in a secondary bath and/or in air at a stretching ratio of from 70% to 90%, preferably 80% to 90% of the maximum stretching ratio as hereinafter defined and
- treating said filaments with a fatty acid ester.

Surprisingly it was found, that by spinning a viscose fibre from spinnerets with circular holes under conditions, which allow a slower rate of regeneration, and by application of high stretch, the fibre shows a significantly better Syngina absorbency than regular viscose fibres, up to the same level as trilobal viscose fibres spun from trilobal spinnerets. The fibre, furthermore, offers significant advantages in carding and tampon manufacturing due to its chemical crimp and special surface structure.

Stretching of the filaments should be performed at a stretching ratio of from 70% to 90%, preferably 80% to 90% of the maximum stretching ratio.

The maximum stretching ratio depends on various parameters, such as the degree of regeneration of the filaments, the spinning speed, the size of the spinneret and/or the number of spinning positions in a production line, and may be determined in each case in advance by means of a tension meter:

A tow of viscose filaments spun from a viscose dope and regenerated in a regeneration bath under the same conditions and with the same equipment as the conditions/the equipment which are intended to be applied/used for producing the desired fibres, is stretched in air and/or in a hot secondary bath located between two godets of different speed. A tension meter measures the tension of the tow directly before the second godet.

Starting from a low level of stretch, the speed of the first godet is reduced slowly step by step, thus increasing the stretching ratio. By raising the stretching ratio, the tension of the tow also increases until maximum tension and stretching ratio are obtained. Beyond this point, individual filaments start to break and the tension of the tow drops. The stretching ratio where maximum stretching level has been recorded, is the so-called "maximum stretching ratio". According to the present invention, a total level of stretching has to be applied, which is of from 70% to 90%, preferably 80% to 90% of this maximum stretching ratio. In case of a two-step stretching, the term "stretching ratio" refers to the total amount of stretching applied in the two steps of stretching.

The alkali ratio is calculated by dividing the total alkali concentration (w/w) of the viscose spinning dope by the cellulose concentration (w/w) of the viscose spinning dope. The total alkali concentration is given by the amount of alkali hydroxide, alkali carbonate and alkali sulphide in the viscose dope and is determined by the analytical method according to Jentgen as described in "Chemiefasern nach dem Viskoseverfahren" (K. Götze, 3rd edition, Springer-Verlag 1967).

In a preferred embodiment of the process according to the invention, said alkali ratio is achieved by admixing a suitable amount of alkali into said viscose spinning dope immediately before spinning. This may be achieved by way of injection, for example.

Preferably, the fatty acid ester used to treat the filaments is a polyoxyethylene sorbitan fatty acid ester such as TWEEN® 20 (available from ICI Surfactants).

Treatment of the fibres may occur at any stage of the finishing and aftertreatment processes known from the state of the art of the viscose process, especially in the last treatment step before drying of the fibres. Treatment of the fibres, furthermore, may be carried out during the various steps of further processing of the fibres, such as carding, by way of processes known in the art, such as spray finishing.

Preferably, the fibres are treated with said fatty acid ester in an amount of from 0.03 to 0.7% (w/w calculated on basis of cellulose), preferably of from 0.3 to 0.4%.

The secondary bath preferably has an elevated temperature. As shown below, stretching of the filaments may be carried out in a secondary bath, in air or in a two-step procedure comprising both alternatives.

In a further preferred embodiment, the filaments are cut to form staple fibre.

Preferably all the spinning holes of the spinneret have a circular orifice. However, it is also possible to extrude filaments from a spinneret comprising both holes with a circular orifice and holes with a different orifice, such as a multilimbed orifice.

The regenerated solid viscose fibre according to the invention is obtainable by the process according to the invention. The fibre according to the invention preferably is present in the form of staple fibre. The titre of the fibre may be in the range of from 0.5 dtex to 6.0 dtex, preferably of from 2.5 dtex to 4 dtex.

The fibre according to the invention is characterised by the following features:

It has a solid, not hollow or collapsed structure.

It exhibits a fibre cross-section with irregular limbs. Without wishing to be bound by a specific theory, it is believed that these irregular limbs are obtained by the slow regeneration and strong radial shrinking during spinning. This cross-section enhances the stiffness of the fibres and provides a higher specific surface.

Although the fibre is a solid fibre and does not have limbs with an aspect ratio of more than 2:1 as disclosed in EP-A1 0 301 874, the fibre shows superior absorbency properties:

- a specific Syngina absorbency of more than 6.0 g/g according to the test method disclosed below
- a water holding capacity measured according to the test method for absorbency of Viscose waddings, Absorbent, described in European Pharmacopoeia 4 01/2002:0034, of more than 23 g/g, preferably of more than 25 g/g
- a water retention value measured according to DIN 53814, using the Wt calculation scheme, of from 70 to 110%, preferably of from 80 to 90%.

The fibre according to the invention, furthermore, exhibits a high level of crimp, providing bulk and excellent processability during carding.

The fibre according to the invention is perfectly suitable for absorbent products, such as a tampon. Therefore, the present invention also provides an absorbent product, such as a tampon, including the fibre according to the invention in staple form.

EXAMPLES

Test Methods

Syngina Test:

The Syngina Test assesses the absorbency of fibres in a tampon. The test as described below is a simplified version of the EDANA Test method ERT 350.0-02.

Figure 6:
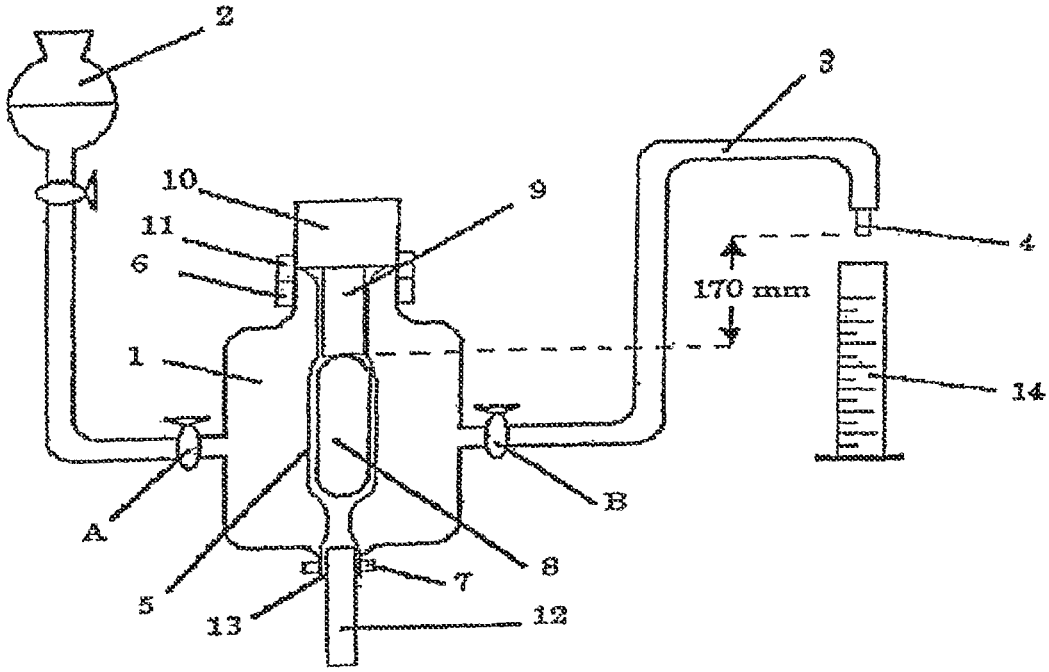
FIG. 6 shows an apparatus used to perform the Syngina test in assessing the absorbency of fibers in a tampon.

FIG. 6 shows the apparatus used to perform the test method, wherein

1 denotes the measuring cell
2 denotes a supplying vessel
3 denotes an overflow line
4 denotes a run out
5 denotes a condom
6, 7, 11 and 13 denote rubber rings, respectively
8 denotes a tampon or tampon-shaped plug
9 denotes a tube
10 denotes a filling tube
12 denotes a run out and
14 denotes a mensur.
A, B denote valves The principle of the test method is to simulate the vaginal environment in the laboratory by applying standard pressure to a tampon inside a flexible membrane, being formed by a condom.

By introducing a certain amount of fluid until the tampon leaks, also the water retention and liquid absorptive capacity and water displacement can be measured. The tampon weight is taken before (dry) and after the test (wet) to calculate the weight of fluid absorbed.

Reagents

As a Syngina fluid, distilled or de-ionised water is used.

Preparation of Specimen 2.75 g of staple fibre with a humidity of 8-11% are weighed and fed into a carding machine type USTER MDTA 3, equipped with a rotoring 3. The speed of the combing roller is 1390 rpm. Each run takes 75 s. The resulting card sliver, which is about 90 cm long, is tripled to form a band with a length of 30 cm, which is pressed between 2 rollers or compacted on a calendar. Application of too high pressure during compacting of the card sliver may lead to the formation of a stiff, cardboard-like material, which has to be avoided.

The weight of the compacted sliver is adjusted to 2.70 g and put into a device to form a cylinder by winding. During this procedure the roll is weighed down by a 150 g counter cylinder.

The sample is then put into a mechanical press for plugs. This is a mechanical device, which is able to form tampon-shaped plugs. The plugs have the same volume, mass and fibre orientation as a commercial digital tampon, including 8 grooves along the side of the cylinder. The plug is pressed with 80 Nm for 10 minutes and is weighed again for redundance immediately before testing.

In FIGS. 7 to 11, the press by means of which the tampon-shaped pressed articles for carrying out the Syngina test are produced is illustrated.

FIG. 7 depicts the mechanical press used to prepare the test specimen for the Syngina test method FIG. 8 is a sectional view of a component of the mechanical press of FIG. 7, according to lines A-A.

FIG. 9 is a sectional view of another component of the mechanical press of FIG. 7, according to lines B-B.

Figure 10:
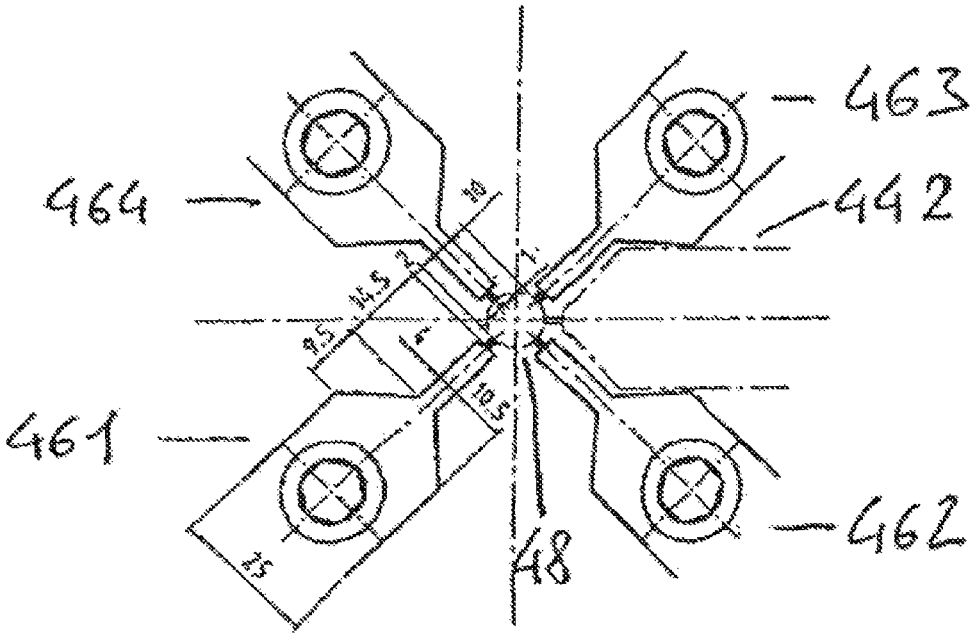
FIG. 10 shows an enlarged view of region "Y" of the mechanical press shown in FIG. 8.

FIG. 10 is an enlarged sectional view of region Y in FIG. 8.

Figure 11:
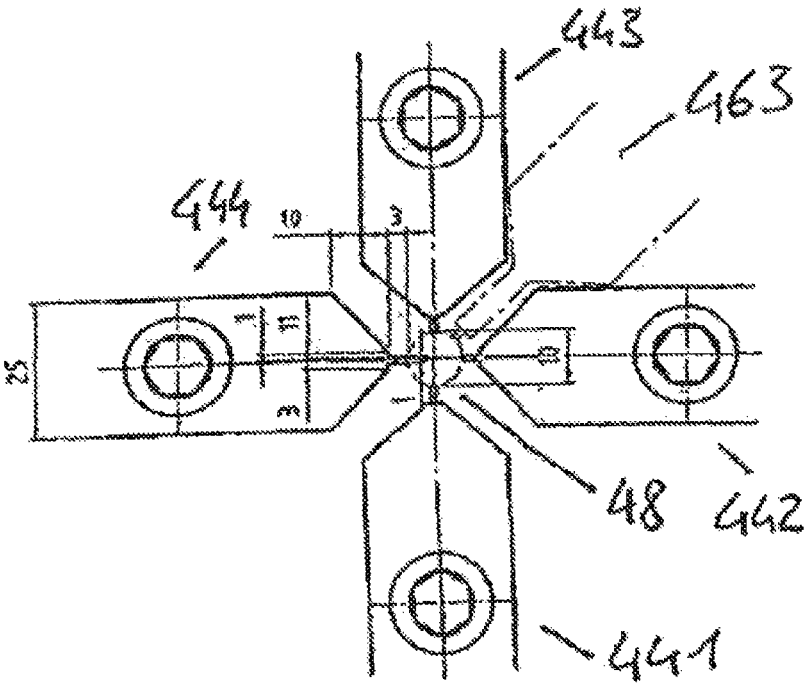
FIG. 11 shows an enlarged view of region "Z" of the mechanical press shown in FIG. 9.

FIG. 11 is an enlarged sectional view of region Z in FIG. 9.

Referring to FIG. 7, the press 41 is arranged on a base plate 42 and consists of a rigidly installed lower bracing 43, in which a lower gripping device 44 is located, and an upper bracing 45 that is pivotable horizontally and vertically displaceable by means of a lifting device 47 and to which an upper gripping device 46 is connected.

FIG. 8 shows a section through the upper gripping device 46 according to lines A-A in FIG. 7. The upper gripping device comprises four upper gripping jaws 461-464.

FIG. 9 shows a section through the lower gripping device 44 according to lines B-B in FIG. 7. The lower gripping device comprises four lower gripping jaws 441-444.

FIG. 10 shows an enlarged section of region Y in FIG. 8. The exact dimensions of the four upper gripping jaws 461-464 result from the dimensions in FIG. 10 (in mm). A lower gripping jaw 442 is illustrated by a segmented line.

FIG. 11 shows an enlarged section of region Z in FIG. 9. The exact dimensions of the four lower gripping jaws 441-444 result from the dimensions in FIG. 11 (in mm). An upper gripping jaw 463 is illustrated by a segmented line.

In order to prepare the sample, the previously prepared compressed and coiled card sliver (weight=2.7 g) is vertically introduced into the opening between the lower gripping jaws 441-444 and is fixed by the aid of a dynamometric key by applying a slight pressure on the lower gripping jaws. Subsequently, the upper gripping device 46 is swivelled in and brought down until the lower gripping jaws 441-444 and the upper gripping jaws 461-464 are flush with each other and—such as can be seen in FIGS. 10 and 11—end up lying alternately adjacent to each other. The coiled card sliver now is located in the space 48 (see FIGS. 10 and 11) that is predefined by the gripping jaws 441-444 and 461-464, respectively, and subsequently is pressed by the tightening of the gripping jaws. For that purpose, a dynamometric key is put into a square neck (not shown) provided in the lower bracing 43 and is tightened so strongly that a torque of 110 Nm is reached. The pressing operation lasts for 10 minutes. In that way, the pressed article receives its characteristic shape with 8 grooves.

This plug can be used for the Syngina test without further modification. The length of the plug is about 53 mm, its diameter is 14-15 mm; it does not change its longitudinal or radial dimension for at least 7 days.

If a tampon is used as a specimen, the wrapping or the applicator have to be removed. The test specimen should be unwrapped immediately before testing, and the withdrawal cord should be cut away.

The number of specimens per test should be three.

Condom Installation and Replacement

A straight unlubricated condom having a tensile strength between 17 Mpa and 30 MPa is used as a test membrane. The condom is opened and unraveled. The condom is marked at 20 mm and 160 mm length from the open end.

The condom is inserted through the chamber 1 of the test apparatus with the aid of a rod, so that the 160 mm mark rests on the edge of the smaller opening of the chamber 1 (bottom of chamber 1).

The tip of the condom is cut and secured with a rubber band such that the 160 mm mark remains on the edge of the smaller opening of chamber 1.

The condom is drawn through the large opening of chamber 1 so that the 20 mm mark rests on the opening's edge and is secured there with a rubber band.

Test condoms are replaced (a) if they leak, (b)—monthly—whichever applies first.

Procedure

The tampon or the pressed plug prepared according to section "Preparation of Specimen" above is weighed to the nearest 0.01 gram. The weight is recorded.

While chamber 1 of the test apparatus is empty, tampon 8 is placed within the condom 5 as shown in FIG. 6 so that the centre of the tampon is at the centre of chamber 1 and the bottom end (end where withdrawal cord is located) is positioned toward the bottom of chamber 1. It is helpful to use tweezers to place the plug in the center of this cell.

After this, valve A is opened so that chamber 1 is filled with water. A small tube 9 is inserted into the chamber 1, so that it contacts the top end of tampon/plug 8. Valve A is closed again.

Then, valve B is opened for pressure equalisation (a pressure equivalent to 170 mm water column is established as can be seen from FIG. 6). Filling tube 10 is inserted with a rubber ring 11. 25 ml test liquid is filled into tube 10. A stop watch is started.

After 3 minutes valve B is closed (except there is still some water replaced via run out 4). If any liquid is standing over the filling tube 10 and small tube 9, it is sucked off with a Socorex pipette. Filling tube 10 is removed, and the measuring cell is raised.

Tube 9 is removed, valve A is opened and the condom is relieved, which makes it easy to remove tampon/plug 8 with tweezers. Afterwards valve A is closed, and chamber 1 is fixed.

The removed tampon/plug is weighed immediately to the nearest 0.01 gram. The wet weight is recorded. The remaining water is drained from chamber 1.

The test should be repeated three times with a new plug from the same fibre sample.

For the test, chamber 1 should be filled without any bubbles.

Calculation and Expression of Results:

The absorbency of each specimen tampon/plug is calculated as follows:

$A=B-C$, wherein

A=Absorbency of the tampon/plug in grams

B=Weight in grams of the saturated (wet) tampon/plug

C=Weight in grams of dry tampon/plug

The results are expressed to the first decimal. The average absorbency of the total number of test specimens is calculated.

The specific Syngina absorbency in g test liquid/g fibre is calculated by dividing the average absorbency (A) by the average weight of the dry tampons/plugs (C) in grams.

Water Retention

Water retention of the fibres is measured according to the test method described in DIN 53814, using the Wt calculation scheme.

Water Holding Capacity

Water holding capacity of the fibres is measured according to the test method for absorbency of Viscose waddings, Absorbent described in European Pharmacopoeia 4 01/2002: 0034.

Crimp

Crimp was measured with a Crimp Tester type "Vibrotex 400" (available from Lenzing Technik GmbH & CoKG).

Example 1

A viscose with the composition 8.25% cellulose, 7.15% alkali (thus having an alkali ratio of 0.87), 2.3% sulfur, a ballfall viscosity of 35 s at 20° C. and a ripening index of 13.5° Hottenroth was spun through a spinneret with 800 holes of circular shape and a diameter of 90 μm. The composition of the spinbath was 98 g/l sulfuric acid, 345 g/l sodium sulphate and 30 g/l zinc sulphate at a temperature of 49° C. The spinning speed was 55 m/min. The maximum stretching ratio was determined at 107%. The filaments were stretched by 90% (which is 84% of the maximum stretching ratio) at 90° C. in a hot secondary bath containing 17 g/l sulfuric acid, cut into staples of 40 mm length, washed, desulfurized, washed again, finally finished with a finishing bath containing 10 g/l of a polyoxyethylene sorbitan fatty acid ester (Tween® 20, available from ICI Surfactants) and dried.

The fibres had a titre of 2.65 dtex, a tenacity in conditioned state of 28.7 cN/tex, an elongation of 15.0% and a Syngina absorbency of 6.3 g/g. The water retention of the fibre was 90%, and the water holding capacity was 27.8 g/g. The fibre had a removing crimp of 16.2% and a recovering crimp of 9.0%.

The finishing level of the fibre determined by extraction and subsequent HPLC analysis was 0.21%.

The cross section of the fibre, especially its irregularly limbed structure, is shown in FIG. 1.

With an aspect ratio of much less than 2:1, typically about 1:1, the limbs are much less fragile than those of a state-of-the-art trilobal fibre, which has a positive influence on the mechanical stability of the fibre during carding and tampon manufacturing.

The positive influence of the polyoxyethylene sorbitan fatty acid ester finish on Syngina absorbency can be demonstrated by comparison of example 1 and 2:

Example 2

A fibre manufactured under the same conditions as described in example 1 was finished with a finishing bath containing 0.3 g/l of a fatty acid polyglycol ester instead of a polyoxyethylene sorbitan fatty acid ester. The finish level of the fibre determined by ethanol extraction and subsequent HPLC analysis was 0.09%. The fibre had a Syngina absorbency of 6.1 g/g.

In order to achieve a high Syngina absorbency, a maximum level of stretch during spinning is essential, as can be demonstrated by comparison of example 1 and 3:

Example 3

A viscose fibre was manufactured under the same conditions as described in example 1, except for the stretching ratio. The maximum stretching ratio was determined to be 104%. During spinning of the fibres only 55% stretch (which is 53% of the maximum stretching ratio) were applied. The fibre was finished with a finishing bath containing 0.3 g/l of a fatty acid polyglycol ester. The finish level of the fibre determined by ethanol extraction and subsequent HPLC analysis was 0.09%.

The Syngina absorbency of the fibre dropped to 5.6 g/g. The fibre had a water retention value of 97.5% and a water holding capacity of 21.5 g/g.

Example 4

Example 4 shows, that spinning of a regular viscose with an alkali ratio of 0.59 into a spinbath with a high zinc concentration does not lead to improved Syngina absorbency, even though a high level of stretch is applied:

A viscose with the composition 8.60% cellulose, 5.09% sodium hydroxide, 2.26% sulfur, a ballfall viscosity of 52 s at 20° C. and a ripening index of 14.5° Hottenroth was spun through a spinneret with 800 holes of circular shape and a diameter of 90 μm. The composition of the spinbath was 100 g/l sulfuric acid, 345 g/l sodium sulphate and 30 g/l zinc sulphate at a temperature of 49° C. The spinning speed was 55 m/min. The filaments were stretched by 87% (85% of the maximum stretching ratio) at 90° C. in a hot secondary bath containing 17 g/l sulfuric acid, cut into staples of 40 mm length, washed, desulfurized, washed again, finally finished with a finishing bath containing 10 g/l of a polyoxyethylene sorbitan fatty acid and dried.

The fibres had a titre of 3.23 dtex, a tenacity in conditioned state of 27.3 cN/tex, an elongation of 15.5% and a Syngina absorbency of 5.6 g/g. The water retention of the fibre was 79.5% and the water holding capacity was 19.0 g/g.

The removing crimp of the fibres was 8.5%, the recovering crimp 4.9%. The finish level of the fibre determined by ethanol extraction and subsequent HPLC analysis was 0.33%.

Figure 2:
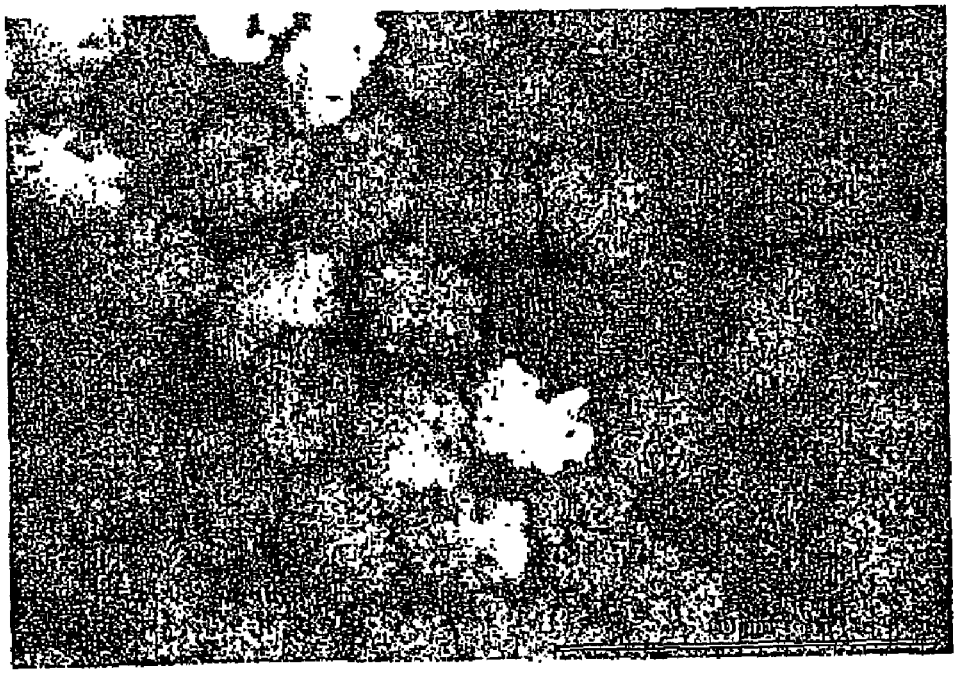
FIG. 2 shows a cross section of fibers obtained through the process described in Example 4.

The cross section of this fibre is depicted in FIG. 2.

Example 5

Alkali Injection

A viscose flow of 106 g/min with the composition of 8.58% cellulose and a 5.19% sodium hydroxide, a ball fall viscosity of 60 s and a ripening index of 13.3° Hottenroth was mixed with a flow of 5.03 g/min of 50% caustic soda and spun by means of a spinneret of 800 holes, each hole having a diameter of 90 μm into a spinbath. The composition of the mixture was 8.25% cellulose, 7.13% sodium hydroxide (alkali ratio=0.86), 2.3% sulfur, and a ballfall viscosity of 36 s.

The spinbath contained 101 g/l sulfuric acid, 350 g/l sodium sulphate, and 31.7 g/l zinc sulphate at a temperature of 49° C. At a spinning speed of 55 m/min, a maximum stretching ratio of 104% was achieved. The filaments were stretched by 88% (which is 85% of the maximum stretching ratio) in a hot secondary bath, and treated under the same conditions as described in example 1.

The fibres had a titre of 2.79 dtex, a tenacity in conditioned state of 28.5 cN/tex, an elongation of 15.6% and a Syngina absorbency of 6.3 g/g. The fibres had a water retention value of 83% and a water holding capacity of 25.4 g/g.

The removing crimp of the fibres was 16.0%, the recovering crimp 8.6%. The finish level of the fibre determined by ethanol extraction and subsequent HPLC analysis was 0.29%.

Figure 3:
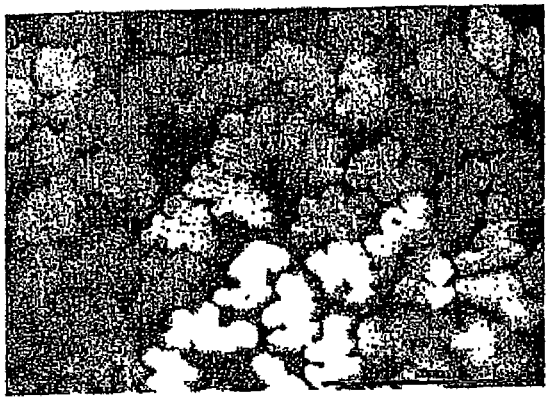
FIG. 3 shows a cross section of fibers obtained through the process described in Example 5.

The cross section of the fibres shows its irregular structure as depicted in FIG. 3.

Example 6

Solid Viscose Fibre According to State of the Art

A viscose comprising 8.63% cellulose, 5.22% alkali (alkali ratio=0.6) and 2.37% sulfur, a ballfall viscosity of 58 s and a ripening index of 14.3° Hottenroth was spun into a spinbath containing 88 g/l sulfuric acid, 267 g/l sodium sulphate and 10 g/l zinc sulphate at a temperature of 53° C. by means of spinnerets with circular holes of 90 μm diameter at a spinning speed of 50 m/min.

The filaments were stretched first by 40% in the air, followed by stretching 13% in a hot secondary bath and cut, washed, desulfurized and bleached. The fibres were finished with a finishing bath containing 10 g/l Tween® 20 (available from ICI Surfactants).

The fibres had a titre of 3.53 dtex, a tenacity of 23.2 cN/tex and an elongation of 21.3% in conditioned state. The Syngina absorbency of the fibre was 5.5 g/g.

Figure 4:
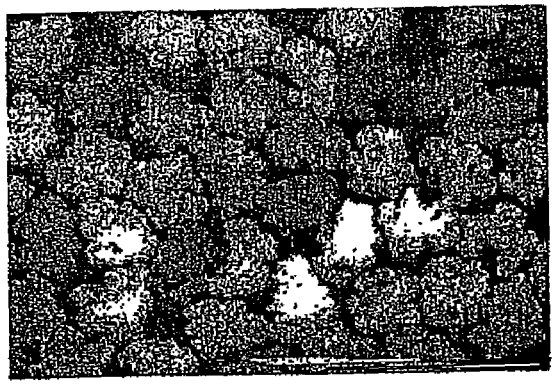
FIG. 4 shows a cross section of fibers obtained through the process described in Example 6.

The cross section of the fibre is shown in FIG. 4.

Example 7

Trilobal Viscose Fibre

A viscose consisting of 8.57% cellulose, 5.2% sodium hydroxide and 2.15% sulfur with a ball fall viscosity of 70 s at 20° C. and a ripening index of 15.3° Hottenroth was spun through a spinneret with Y-shaped holes, the length-to-width ratio of the limbs being 72 μm:33 μm.

The spinbath composition was 130 g/l sulfuric acid, 365 g/l sodium sulphate and 10.3 g/l zinc sulphate at a temperature of 49° C. The filaments were stretched by 17% in the air followed by stretching 36% at 90° C. in a hot secondary bath containing 20 g/l sulfuric acid and then cut into staples of 40 nm length, washed, desulfurized, washed again and finally finished with 1.6 g/l fatty acid polyglycol ester and dried. The spinning speed was 53 m/min.

The fibres had a titre of 3.44 dtex, a tenacity of 20.6 cN/tex and an elongation of 17.5% in conditioned state, a water retention value of 88% and a water holding capacity of 25.2 g/g. The finish level according to the ethanol extract was 0.06%.

Figure 5:
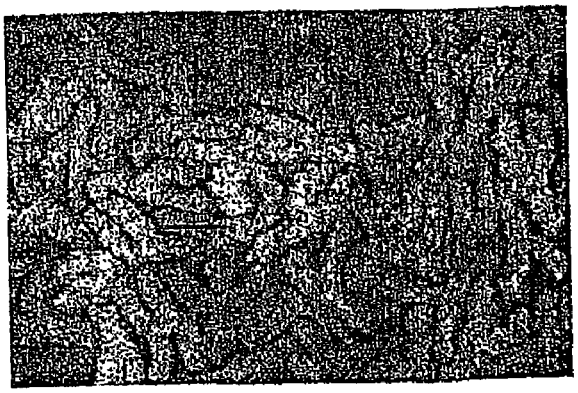
FIG. 5 shows a cross section of fibers obtained through the process described in Example 7.

The Syngina absorbency of the fibre was 6.4 g/g. The shape of the cross section is depicted in FIG. 5.

The invention claimed is:

1. A process for manufacturing solid regenerated viscose fibers comprising (1) spinning a viscose spinning dope through a spinneret comprising spinning holes into a regenerating bath thereby forming filaments, wherein said viscose spinning dope has an alkali ratio immediately before spinning of from 0.7 to 1.0, wherein at least part of said spinning holes have a circular orifice, wherein said regenerating bath contains from 70 to 120 g/l of sulfuric acid, from 240 to 380 g/l of sodium sulphate, from 20 to 50 g/l of zinc sulphate and wherein said regenerating bath has a temperature of from 45 to 55° C., (2) stretching said filaments after leaving said regenerating bath in a secondary bath and/or in air at a stretching ratio of from 70% to 90% of a maximum stretching ratio and (3) treating said filaments with a fatty acid ester thereby forming said fibers.

2. The process of claim 1, wherein the regenerating bath contains from 90 to 110 g/l of sulfuric acid.

3. The process of claim 1, wherein the regenerating bath contains from 330 to 370 g/l, of sodium sulphate.

4. The process of claim 1, wherein the regenerating bath contains from 25 to 35 g/l of zinc sulphate.

5. The process of claim 1, wherein the regenerating bath has a temperature of from 48 to 50° C.

6. The process of claim 1, wherein the stretching ratio is from 80% to 90%, of the maximum stretching ratio.

7. The process of claim 1, wherein a suitable amount of alkali is admixed into the viscose spinning dope immediately before spinning to achieve the desired alkali ratio.

8. The process of claim 1, wherein the fatty acid ester is polyoxethylene sorbitan fatty acid ester.

9. The process of claim 1, wherein the fatty acid ester is present in an amount of from 0.03 to 0.7% (w/w calculated on basis of cellulose).

10. The process of claim 1, wherein the secondary bath has an elevated temperature in comparison to the temperature of the regenerating bath.

11. The process of claim 1, further comprising cutting the filaments to form staple fiber.

12. The process of claim 1, wherein all of said spinning holes have a circular orifice.

13. The process of claim 1, wherein the viscose spinning dope has an alkali ratio immediately before spinning of from 0.8 to 0.9.

14. The process of claim 9, wherein the fatty acid ester is present in an amount of from 0.3 to 0.4% (w/w calculated on basis of cellulose).

* * * * *